US011193488B2

(12) United States Patent
Fukuhara et al.

(10) Patent No.: US 11,193,488 B2
(45) Date of Patent: Dec. 7, 2021

(54) SCROLL COMPRESSOR

(71) Applicant: Mitsubishi Electric Corporation, Tokyo (JP)

(72) Inventors: Koichi Fukuhara, Tokyo (JP); Tomokazu Matsui, Tokyo (JP); Yuji Takamura, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 11 days.

(21) Appl. No.: 16/619,507

(22) PCT Filed: Aug. 4, 2017

(86) PCT No.: PCT/JP2017/028369
§ 371 (c)(1),
(2) Date: Dec. 5, 2019

(87) PCT Pub. No.: WO2019/026272
PCT Pub. Date: Feb. 7, 2019

(65) Prior Publication Data

US 2020/0400143 A1 Dec. 24, 2020

(51) Int. Cl.
*F04C 18/02* (2006.01)
*F04C 29/00* (2006.01)

(52) U.S. Cl.
CPC ..... *F04C 18/0215* (2013.01); *F04C 29/0021* (2013.01); *F04C 2210/268* (2013.01); *F04C 2240/60* (2013.01); *F04C 2240/807* (2013.01)

(58) Field of Classification Search
CPC ..... F04C 18/0215; F04C 2240/807; F04C 2240/60; F04C 2210/268; F04C 29/0021
See application file for complete search history.

(56) References Cited

U.S. PATENT DOCUMENTS

2016/0003252 A1* 1/2016 Fukaya ..... F04C 29/02 418/55.6
2017/0089341 A1* 3/2017 Takamura ..... F04C 23/008
2019/0063436 A1 2/2019 Takamura et al.

FOREIGN PATENT DOCUMENTS

EP 3159544 A1 * 4/2017 ..... F04C 18/0215
JP H10-281083 A 10/1998
(Continued)

OTHER PUBLICATIONS

International Search Report of the International Searching Authority dated Oct. 3, 2017 for the corresponding international application No. PCT/JP2017/028369 (and English translation).
(Continued)

*Primary Examiner* — Mark A Laurenzi
*Assistant Examiner* — Xiaoting Hu
(74) *Attorney, Agent, or Firm* — Posz Law Group, PLC

(57) ABSTRACT

A scroll compressor includes a slider. The slider includes a cylindrical portion and a balance weight portion. The balance weight portion includes a counter weight part, a first main weight component, and a second main weight component. The counter weight part has a first outer circumferential surface that is a partial cylindrical surface about the axis of rotation of the slider. The first main weight component has a second outer circumferential surface that is a partial cylindrical surface about the axis of the cylindrical portion. The second main weight component has a third outer circumferential surface that is located radially outward of the second outer circumferential surface and that is a partial cylindrical surface about the axis of rotation of the slider and an inner circumferential surface that is a partial cylindrical surface about the axis of the cylindrical portion.

7 Claims, 6 Drawing Sheets

(56) References Cited

FOREIGN PATENT DOCUMENTS

| | | | | | |
|---|---|---|---|---|---|
| WO | WO-2015194000 | A1 | * | 12/2015 | ..... F04C 29/0021 |
| WO | 2017/085783 | A1 | | 5/2017 | |
| WO | 2017/199588 | A1 | | 11/2017 | |

OTHER PUBLICATIONS

European Office Action dated Mar. 5, 2021, issued in corresponding European Patent Application No. 17920212.2.
Chinese Office Action dated Mar. 11, 2021, issued in corresponding Chinese Patent Application No. 201780093358.5 (and English Machine Translation).
European Office Action dated Sep. 8, 2021, issued in corresponding EP Patent Application No. 17920212.2.

* cited by examiner

SCROLL COMPRESSOR

CROSS REFERENCE TO RELATED APPLICATION

This application is a U.S. national stage application of PCT/JP2017/028369 filed on Aug. 4, 2017, the contents of which are incorporated herein by reference.

TECHNICAL FIELD

The present invention relates to a scroll compressor that is used in, for example, a refrigeration apparatus or an air-conditioning apparatus.

BACKGROUND ART

Patent Literature 1 discloses a scroll compressor including a slider with a balance weight. In this scroll compressor, the position of the center of gravity of the slider with the balance weight in an axial direction of the slider substantially coincides with the middle of a range of rotation and sliding of an orbiting bearing and an outer circumferential surface of the slider in the axial direction. Thus, the point of action of a centrifugal force acting on the slider with the balance weight and the point of support of the centrifugal force in a radial direction of the slider are located on substantially the same plane. This prevents uneven contact between the orbiting bearing and the outer circumferential surface of the slider.

CITATION LIST

Patent Literature

Patent Literature 1: Japanese Unexamined Patent Application Publication No. 10-281083

SUMMARY OF INVENTION

Technical Problem

The slider with the balance weight requires a complicated shape to make the position of the center of action of a centrifugal force acting on the slider with the balance weight in the axial direction coincide with the middle of the above-described range of rotation and sliding and to suppress an increase in dimensions of the slider in the axial and radial directions. Disadvantageously, this leads to an increased number of machining steps for the slider, causing an increase in machining cost of the slider.

The present invention has been made to overcome the above-described disadvantages and aims to provide a scroll compressor that includes a slider produced by a reduced number of machining steps and in which uneven contact between the slider and an orbiting bearing is prevented.

Solution to Problem

A scroll compressor according to an embodiment of the present invention includes a fixed scroll, an orbiting scroll orbiting relative to the fixed scroll, a main shaft transmitting a rotational driving force to the orbiting scroll, an eccentric shaft that is disposed at a first end of the main shaft and is located eccentrically with respect to an axis of the main shaft in an eccentric direction, a slider having a slide hole slidably receiving the eccentric shaft, and an orbiting bearing that is located at the orbiting scroll and rotatably supports the slider. The slider includes a cylindrical portion rotatably supported by the orbiting bearing and a balance weight portion located radially outward of the cylindrical portion. Assuming that a counter-eccentric direction is a direction opposite to the eccentric direction, the balance weight portion includes a counter weight part located in the eccentric direction of a rotation axis of the slider and joined to the cylindrical portion, a first main weight component located in the counter-eccentric direction of the rotation axis of the slider and joined to the cylindrical portion, and a second main weight component located in the counter-eccentric direction of the rotation axis of the slider and protruding from peripheral part of the first main weight component toward the orbiting scroll. The counter weight part has a first outer circumferential surface that is a partial cylindrical surface about the rotation axis of the slider. The first main weight component has a second outer circumferential surface that is a partial cylindrical surface about an axis of the cylindrical portion. The second main weight component has a third outer circumferential surface that is located radially outward of the second outer circumferential surface and that is a partial cylindrical surface about the rotation axis of the slider and an inner circumferential surface that is a partial cylindrical surface about the axis of the cylindrical portion.

Advantageous Effects of Invention

According to the embodiment of the present invention, the number of machining axes necessary for machining the cylindrical surfaces of the balance weight portion is two. This results in a reduced number of machining steps for the slider. The first main weight component has the second outer circumferential surface located radially inward of the third outer circumferential surface of the second main weight component. This arrangement enables the position of the center of action of a centrifugal force acting on the slider in its axial direction to coincide with the middle of a range of rotation and sliding of the slider and the orbiting bearing in the axial direction. This prevents uneven contact between the orbiting bearing and the slider.

DESCRIPTION OF EMBODIMENTS

Embodiment 1

Figure 1:
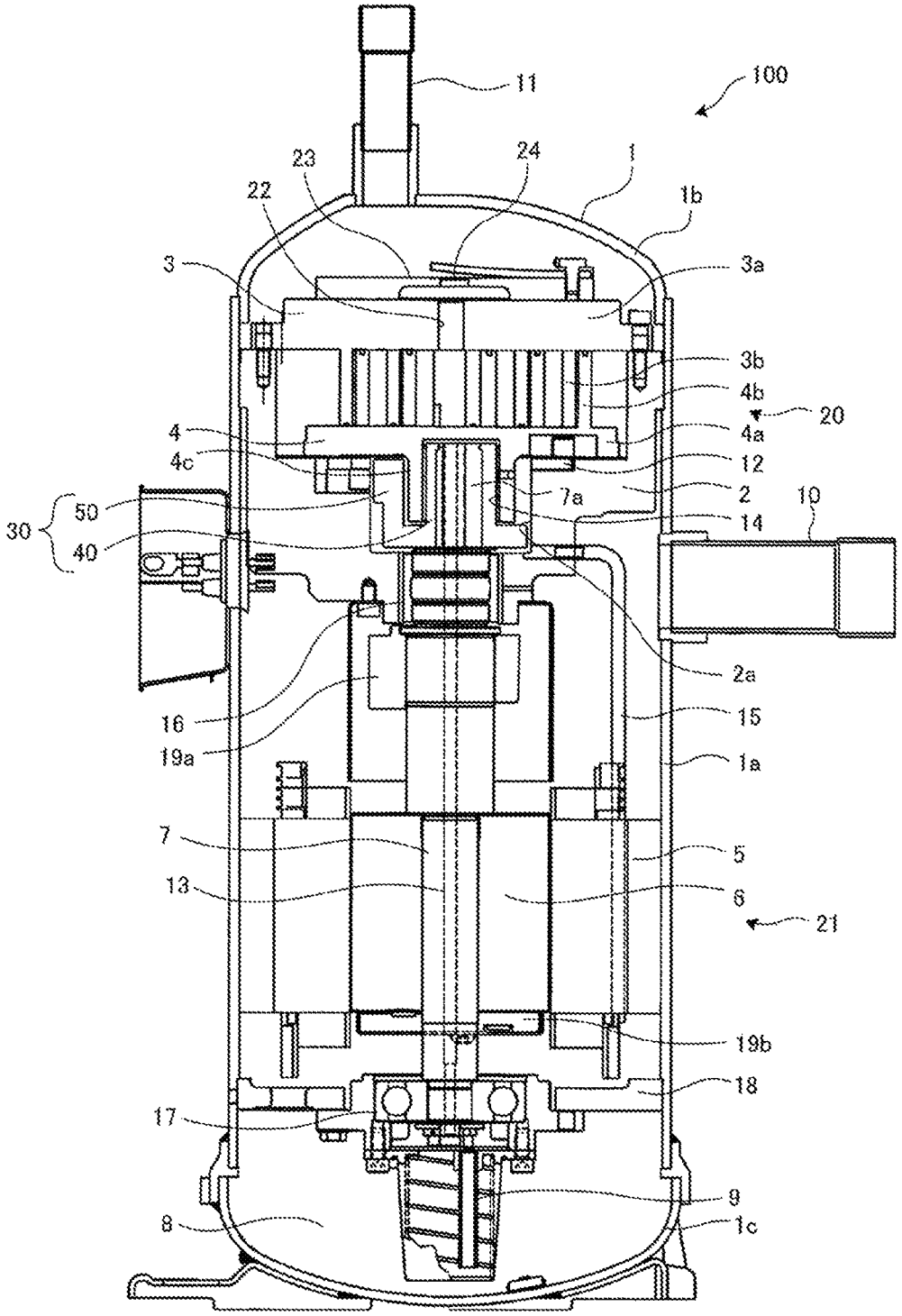
FIG. 1 is a schematic sectional view illustrating the configuration of a scroll compressor 100 according to Embodiment 1 of the present invention.

A scroll compressor according to Embodiment 1 of the present invention will be described. FIG. 1 is a schematic sectional view illustrating the configuration of a scroll compressor 100 according to Embodiment 1 of the present invention. For convenience in identifying leader lines in FIG. 1, hatching for sections is omitted. The scroll compressor 100 is one of components of a refrigeration cycle apparatus that is used as, for example, a refrigerator, a freezer, a vending machine, an air-conditioning apparatus, a refrigeration apparatus, or a water heater. In Embodiment 1, a vertical-type scroll compressor, in which a main shaft 7 extends vertically, is illustrated as an example of the scroll compressor 100. The positional relationship between the components (in, for example, an up-down direction) in the following description, in principle, is provided in a state where the scroll compressor 100 is placed in position ready for use.

The scroll compressor 100 sucks refrigerant that is circulated through a refrigerant circuit of the refrigeration cycle apparatus, compresses the refrigerant into a high-temperature high-pressure state, and discharges the refrigerant. Examples of the refrigerant include R410A refrigerant, R32 refrigerant, and HFO-1234yf refrigerant.

As illustrated in FIG. 1, the scroll compressor 100 includes a compression mechanism 20 to compress the refrigerant, a motor mechanism 21 to drive the compression mechanism 20, and a hermetic container 1 containing the compression mechanism 20 and the motor mechanism 21. The compression mechanism 20 is located in upper part of the hermetic container 1. The motor mechanism 21 is located below the compression mechanism 20 in the hermetic container 1.

The hermetic container 1 includes a cylindrical barrel 1*a*, a top 1*b* disposed at an upper end of the barrel 1*a*, and a bottom 1*c* disposed at a lower end of the barrel 1*a*. The top 1*b*, the barrel 1*a*, and the bottom 1*c* are hermetically joined together by, for example, welding.

The compression mechanism 20 includes a fixed scroll 3 fixed to a frame 2 attached to the hermetic container 1 and an orbiting scroll 4 orbiting relative to the fixed scroll 3. The fixed scroll 3 includes an end plate 3*a* and a scroll lap 3*b* located on one surface (lower surface in FIG. 1) of the end plate 3*a*. The orbiting scroll 4 includes an end plate 4*a* and a scroll lap 4*b* located on one surface (upper surface in FIG. 1) of the end plate 4*a*. The fixed scroll 3 and the orbiting scroll 4 are combined such that the lap 3*b* engages with the lap 4*b*. The laps 3*b* and 4*b* define a compression chamber, in which the refrigerant is compressed, therebetween.

The end plate 3*a* of the fixed scroll 3 has in its central part a discharge port 22, through which the compressed refrigerant is discharged from the compression chamber, extending through the end plate 3*a*. A discharge chamber 23 is located adjacent to an outlet of the discharge port 22. The discharge chamber 23 has a discharge outlet at which a discharge valve 24 having a reed valve structure is disposed.

The end plate 4*a* of the orbiting scroll 4 has a hollow cylindrical boss 4*c* located at central part of the opposite surface (lower surface in FIG. 1) of the end plate 4*a* from the lap 4*b*. The boss 4*c* has in its inner part an orbiting bearing 14 rotatably supporting a cylindrical portion 40 of a slider 30, which will be described later. The axis of the orbiting bearing 14 is parallel to the axis of the main shaft 7.

An Oldham ring 12 is disposed between the orbiting scroll 4 and the frame 2. The Oldham ring 12 includes a ring portion, a pair of Oldham keys arranged on an upper surface of the ring portion, and a pair of Oldham keys arranged on a lower surface of the ring portion. The Oldham keys on the upper surface are placed in key grooves arranged in the orbiting scroll 4 and are slidable in one direction. The Oldham keys on the lower surface are placed in key grooves arranged in the frame 2 and are slidable in a direction orthogonal to the above-described one direction. This arrangement allows the orbiting scroll 4 to orbit without rotating.

The motor mechanism 21 includes a stator 5 fixed to an inner circumferential surface of the hermetic container 1, a rotor 6 disposed radially inward of the stator 5, and the main shaft 7 fixed to the rotor 6. When the stator 5 is energized, the rotor 6 rotates together with the main shaft 7. The main shaft 7 is rotatably supported at its upper end by a main bearing 16 located in the frame 2. The main shaft 7 is rotatably supported at its lower end by a subbearing 17, which includes a ball bearing. The subbearing 17 is located in a subframe 18 fixed to lower part of the hermetic container 1.

The main shaft 7 includes an eccentric shaft 7*a* at the upper end. The eccentric shaft 7*a* is located eccentrically with respect to the axis of the main shaft 7 in a predetermined eccentric direction. The eccentric shaft 7*a* is slidably placed in a slide hole 43 of the slider 30, which will be described later.

The hermetic container 1 has in its bottom part an oil sump 8 holding lubricating oil. An oil pump 9 that sucks the lubricating oil in the oil sump 8 is disposed at the lower end of the main shaft 7. The main shaft 7 has therein an oil hole 13 extending along the axis of the main shaft 7. The lubricating oil sucked from the oil sump 8 by the oil pump 9 passes through the oil hole 13 and is then supplied to sliding parts including the orbiting bearing 14. The frame 2 is connected to a scavenge oil pipe 15 through which the lubricating oil in the frame 2 is returned to the oil sump 8.

A first balancer 19*a* to cancel unbalance caused by orbiting of the orbiting scroll 4 is disposed at upper part of the main shaft 7. A second balancer 19*b* to cancel unbalance caused by orbiting of the orbiting scroll 4 is disposed on a lower end of the rotor 6.

The hermetic container 1 further includes a suction pipe 10 through which low-pressure gas refrigerant is sucked from the outside and a discharge pipe 11 through which compressed high-pressure gas refrigerant is discharged to the outside.

An overall operation of the scroll compressor 100 will now be described in brief. When the stator 5 is energized, the rotor 6 rotates. A rotational driving force produced by the rotor 6 is transmitted to the orbiting scroll 4 via the main shaft 7, the eccentric shaft 7*a*, and the slider 30. The orbiting scroll 4 that has received the rotational driving force is inhibited from rotating by the Oldham ring 12 and thus orbits relative to the fixed scroll 3.

As the orbiting scroll 4 orbits, low-pressure gas refrigerant sucked into the hermetic container 1 through the suction pipe 10 passes through a suction port (not illustrated) located in the frame 2 into the compression chamber, where the refrigerant is compressed. The compressed high-pressure gas refrigerant is discharged into the discharge chamber 23 through the discharge port 22. The high-pressure gas refrigerant in the discharge chamber 23 pushes the discharge valve 24 upward and is discharged into a high-pressure space between the fixed scroll 3 and the hermetic container 1. After that, the refrigerant is discharged out of the scroll compressor 100 through the discharge pipe 11.

A slider 30 that is a prerequisite for Embodiment 1 will now be described. The slider 30 described herein is an example of a slider with a balance weight configured such that the position of the center of action of a centrifugal force acting on the slider 30 in the axial direction coincides with the middle of a range of rotation and sliding of the slider 30 and the orbiting bearing 14 in the axial direction.

Figure 2:
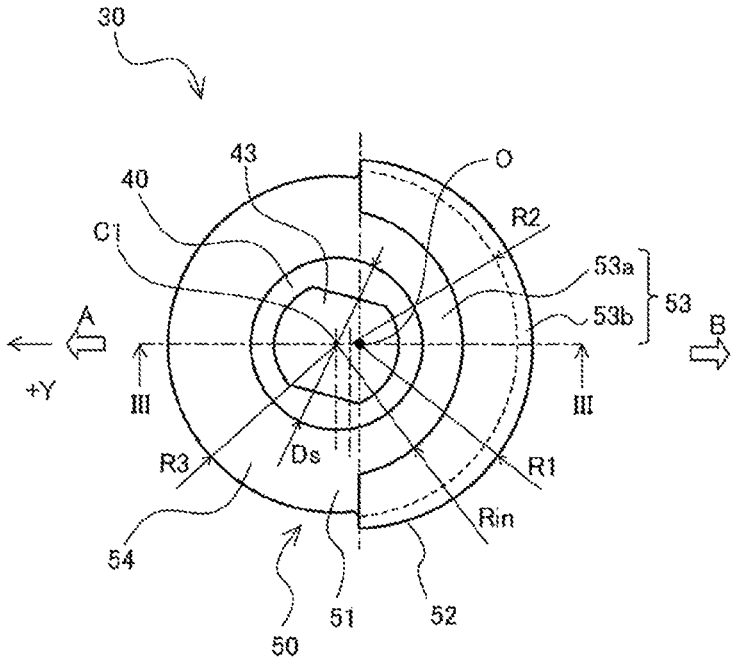
FIG. 2 is a top plan view illustrating the structure of a slider 30 that is a prerequisite for Embodiment 1 of the present invention.
Figure 3:
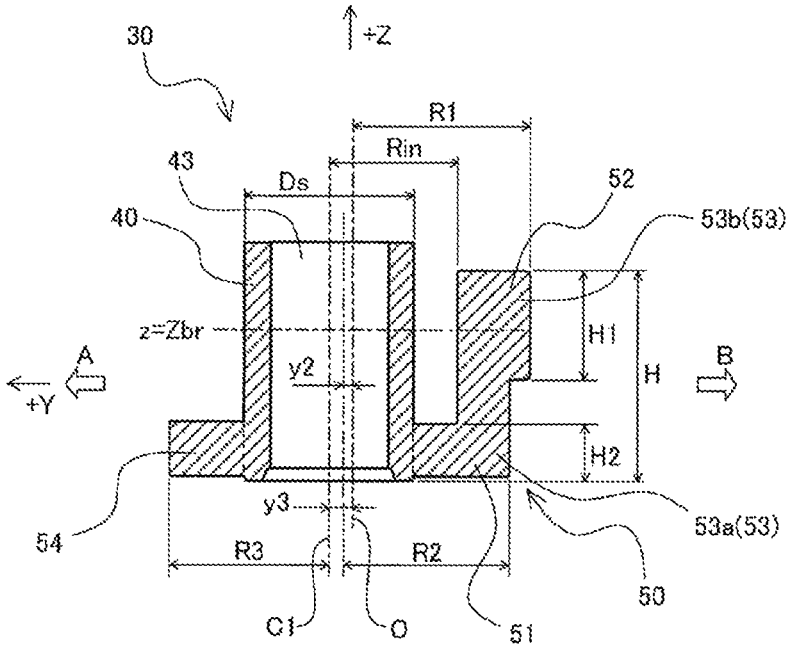
FIG. 3 is a sectional view taken along line III-Ill in FIG. 2.
Figure 4:
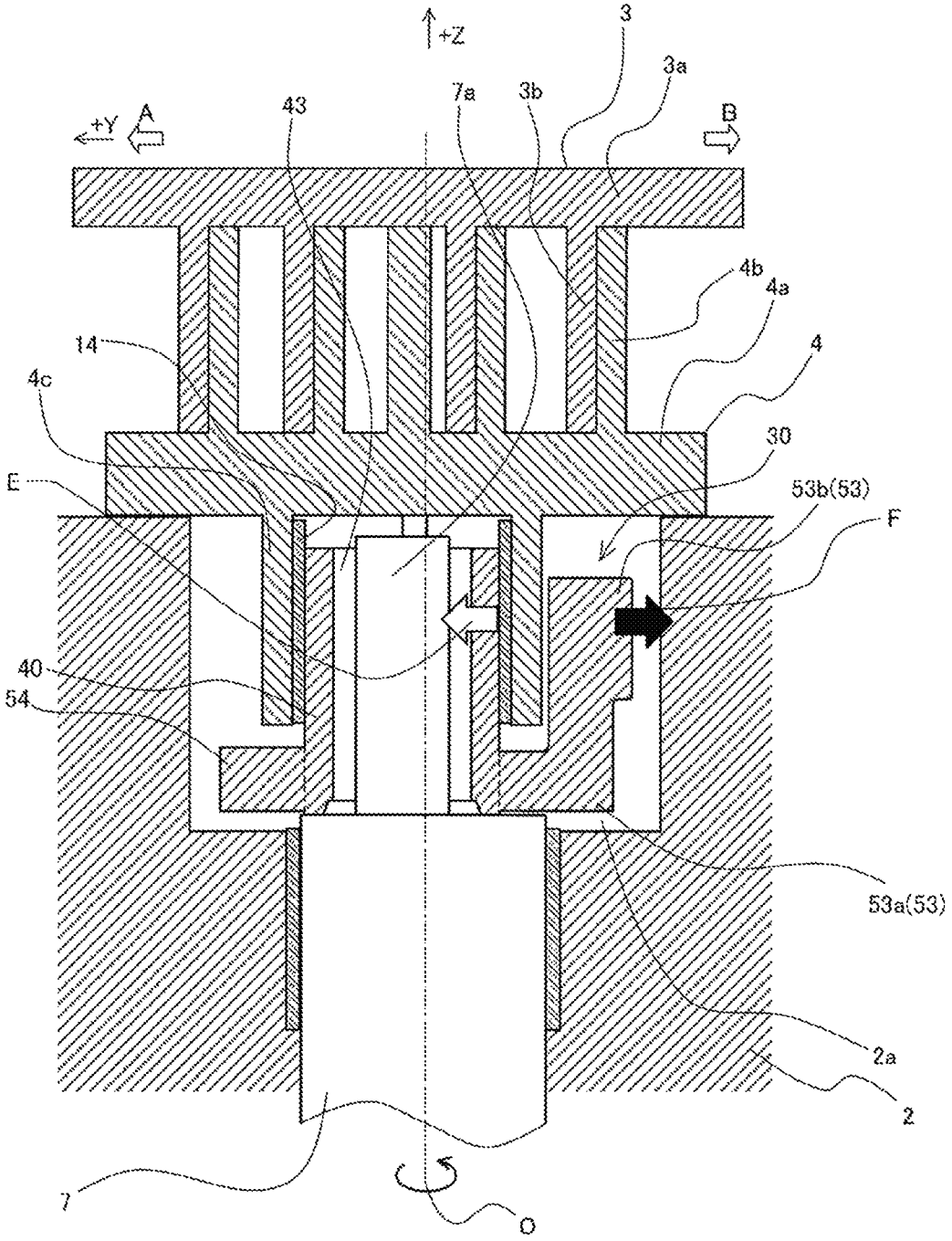
FIG. 4 is a sectional view illustrating essential components of a scroll compressor including the slider 30 that is the prerequisite for Embodiment 1 of the present invention.

FIG. 2 is a top plan view illustrating the structure of the slider 30 that is the prerequisite for Embodiment 1. FIG. 3 is a sectional view taken along line III-III in FIG. 2. FIG. 4 is a sectional view illustrating essential components of a scroll compressor including the slider 30 that is the prerequisite for Embodiment 1. FIG. 4 schematically illustrates the position of a centrifugal force acting on the slider 30 and the position of action of an oil film reaction force. In FIGS. 2 to 4, open arrows A represent an eccentric direction in which the eccentric shaft 7*a* is eccentric with respect to the axis of the main shaft 7, or the eccentric direction in which the orbiting bearing 14 is eccentric with respect to the axis of the main shaft 7. In FIGS. 2 to 4, open arrows B represent a counter-eccentric direction that is opposite to the above-described eccentric direction. The eccentric direction and the counter-eccentric direction are perpendicular to the axis of the main shaft 7. As used herein, the Y axis is parallel to the eccentric direction and the counter-eccentric direction, and the eccentric direction refers to a +Y direction. The Z axis is parallel to the axis of the main shaft 7, or extends vertically, and an upward direction refers to a +Z direction.

The slider 30 is included in a variable crank mechanism that changes the radius of orbiting of the orbiting scroll 4 along the side of the lap 3*b* of the fixed scroll 3. The slider 30 includes the cylindrical portion 40 rotatably supported by the orbiting bearing 14 and a balance weight portion 50 that cancels at least part of a centrifugal force acting on the orbiting scroll 4. The slider 30 is received in a recess 2*a* of the frame 2. The slider 30 has a rotation axis O, which coincides with the axis of the main shaft 7. The cylindrical portion 40 may be joined to the balance weight portion 50 in any manner. For example, the cylindrical portion 40 and the balance weight portion 50 may be joined together in such a manner that these portions molded as separate parts are secured to each other. The cylindrical portion 40 and the balance weight portion 50 can be secured to each other by, for example, shrink-fitting or press-fitting.

The cylindrical portion 40 has an outer circumferential surface that is a cylindrical surface having an outside diameter Ds. The outer circumferential surface is a surface sliding relative to the orbiting bearing 14. The cylindrical portion 40 has an axis C1 located at a distance y3 from the rotation axis O of the slider 30 in the eccentric direction, or the +Y direction. The cylindrical portion 40 has therein the slide hole 43 having a long-hole-shaped cross-section. The eccentric shaft 7*a* is placed in the slide hole 43. The eccentric shaft 7*a* in the slide hole 43 is slidable relative to the slide hole 43 in a predetermined sliding direction perpendicular to the rotation axis O. In this example, the sliding direction in which the eccentric shaft 7*a* slides relative to the slide hole 43 is inclined to the eccentric direction of the eccentric shaft 7*a*.

The balance weight portion 50 includes a flat part 51 and a protrusion 52. The flat part 51 is a substantially disc-shaped part surrounding outer circumferential part of the cylindrical portion 40 and having a thickness H2, and is joined to the cylindrical portion 40. As illustrated in FIGS. 1 and 4, upper part of the cylindrical portion 40 is placed in the orbiting bearing 14. Thus, the cylindrical portion 40 and the flat part 51 are joined at a distance from an end of the orbiting bearing 14 in the Z-axis direction away from the orbiting scroll 4, or at a position below a lower end of the orbiting bearing 14. The protrusion 52 is a part protruding from the flat part 51 toward the orbiting scroll 4, or upward. The protrusion 52 is located in the counter-eccentric direction of the rotation axis O of the slider 30. Furthermore, the protrusion 52 is located at a distance corresponding to a radius Rin from the axis C1 of the cylindrical portion 40 to avoid interference with the orbiting bearing 14 and the boss 4*c*.

To cancel a centrifugal force acting on the orbiting scroll 4, the whole of the balance weight portion 50 is disposed eccentrically with respect to the rotation axis O in the counter-eccentric direction. At least part of the centrifugal force acting on the orbiting scroll 4 is cancelled by a centrifugal force acting on the balance weight portion 50, thus reducing a radial load acting on the lap 4*b* of the orbiting scroll 4. This leads to improved reliability of the orbiting scroll 4 and reduced sliding loss between the lap 4*b* of the orbiting scroll 4 and the lap 3*b* of the fixed scroll 3.

For the center of action of an oil film reaction force that is generated between the orbiting bearing 14 and the outer circumferential surface of the cylindrical portion 40 of the slider 30 when the slider 30 rotates, the center of action of the oil film reaction force coincides with the middle of the orbiting bearing 14 in the Z-axis direction, as represented by an open arrow E in FIG. 4. If the position of the center of action of the centrifugal force acting on the slider 30 deviates from the middle of the orbiting bearing 14 in the Z-axis direction, the slider 30 will tend to overturn to make the center of action of the oil film reaction force coincide with the center of action of the centrifugal force, causing uneven contact between the cylindrical portion 40 of the slider 30 and the orbiting bearing 14. It is, therefore, necessary to design the slider 30 so that the position of the center of action of the centrifugal force acting on the slider 30 substantially coincides with the middle of the orbiting bearing 14 in the Z-axis direction.

However, the slider 30 needs to be designed under the following restrictions. The cylindrical portion 40 and the balance weight portion 50 of the slider 30 need to be joined together at a position where these portions do not interfere with the orbiting bearing 14 and the boss 4*c*. In other words, a junction between the cylindrical portion 40 and the balance weight portion 50 is located at a position where the junction does not interfere with the orbiting bearing 14 and the boss 4*c*. In the vertical-type scroll compressor 100, the junction between the cylindrical portion 40 and the balance weight portion 50 of the slider 30 is located below the orbiting bearing 14. This junction needs to have a certain thickness in terms of strength to support a centrifugal force acting on the balance weight portion 50. Thus, the center of action of a centrifugal force acting on the entire slider 30 tends to be located at a lower level due to a centrifugal force acting on the above-described junction. To make the position of the center of action of the centrifugal force acting on the slider 30 substantially coincide with the middle of the orbiting bearing 14, therefore, the center of action of the centrifugal force acting on the slider 30 needs to be shifted upward.

The balance weight portion 50 of the slider 30 in FIGS. 2 to 4 includes a main weight part 53 located in the counter-eccentric direction of the rotation axis O of the slider 30 and a counter weight part 54 located in the eccentric direction of the rotation axis O of the slider 30. In Embodiment 1, the main weight part 53 includes a first main weight component 53*a* and a second main weight component 53*b*.

The counter weight part 54 is a portion of the flat part 51 that is located in the eccentric direction of the rotation axis O of the slider 30. The counter weight part 54 is located at a position farther away from the orbiting scroll 4 than the orbiting bearing 14 in the Z-axis direction, or a position farther away from the orbiting scroll 4 than the middle of the orbiting bearing 14 in the Z-axis direction. The counter weight part 54 has an outer circumferential surface that is a partial circumferential surface having a radius R3 about the axis C1 of the cylindrical portion 40.

The first main weight component 53*a* includes a portion of the flat part 51 that is located in the counter-eccentric direction of the rotation axis O of the slider 30 and a lower portion of the protrusion 52. The first main weight component 53*a* is located at a position farther away from the orbiting scroll 4 than the second main weight component 53*b*. The first main weight component 53*a* has an outer circumferential surface that is a partial cylindrical surface having a radius R2 about a position at a distance y2 from the rotation axis O of the slider 30 in the +Y direction. The distance y2 is smaller than the distance y3 (y2<y3).

The second main weight component 53*b* is an upper portion of the protrusion 52. The main weight part 53 has an overall height H. A portion of the main weight part 53 that has a height H1 measured from the upper end of the main weight part 53 corresponds to the second main weight component 53*b*. The second main weight component 53*b* is located closer to the orbiting scroll 4 than the first main weight component 53*a*. The second main weight component 53*b* has an outer circumferential surface that is a partial cylindrical surface having a radius R1 about the rotation axis O of the slider 30. The second main weight component 53*b* further has an inner circumferential surface that is a partial cylindrical surface having the radius Rin about the axis C1 of the cylindrical portion 40.

The outer circumferential surface of the second main weight component 53*b* is located radially outward of the outer circumferential surface of the first main weight component 53*a*. This arrangement causes a centrifugal force (cross-sectional area x distance to centroid) per unit thickness of the second main weight component 53*b* to be larger than that of the first main weight component 53*a*. This allows the center of action of a centrifugal force acting on the main weight part 53 in the Z-axis direction to be shifted toward the orbiting scroll 4, or shifted upward. Therefore, the slider 30 in FIGS. 2 to 4 allows the position of the center of action of a centrifugal force acting on the slider 30 that is represented by a filled arrow F in FIG. 4 in the Z-axis direction to substantially coincide with the position of the center of action of the oil film reaction force represented by the open arrow E in FIG. 4 in the Z-axis direction, thus preventing uneven contact between the cylindrical portion 40 of the slider 30 and the orbiting bearing 14. Furthermore, this arrangement suppresses an increase in dimensions in the axial and radial directions of the slider 30, resulting in a compact structure of the slider 30.

However, the slider 30 illustrated in FIGS. 2 to 4 requires many machining axes for the cylindrical surfaces of the slider 30 in a machining step, such as grinding or polishing. For example, the axis C1 of the cylindrical portion 40 serves as a machining axis for the outer circumferential surface of the counter weight part 54 and the inner circumferential surface of the second main weight component 53*b*. The position at the distance y2 from the rotation axis O of the slider 30 in the +Y direction coincides with a machining axis for the outer circumferential surface of the first main weight component 53*a*. The rotation axis O of the slider 30 serves as a machining axis for the outer circumferential surface of the second main weight component 53*b*. In other words, the balance weight portion 50 of the slider 30 illustrated in FIGS. 2 to 4 has at least three machining axes. The slider 30 illustrated in FIGS. 2 to 4, therefore, has disadvantages in that the number of machining steps for the slider 30 is increased and this leads to an increased machining cost of the slider 30 and an increased manufacturing cost of the scroll compressor 100.

Figure 5:
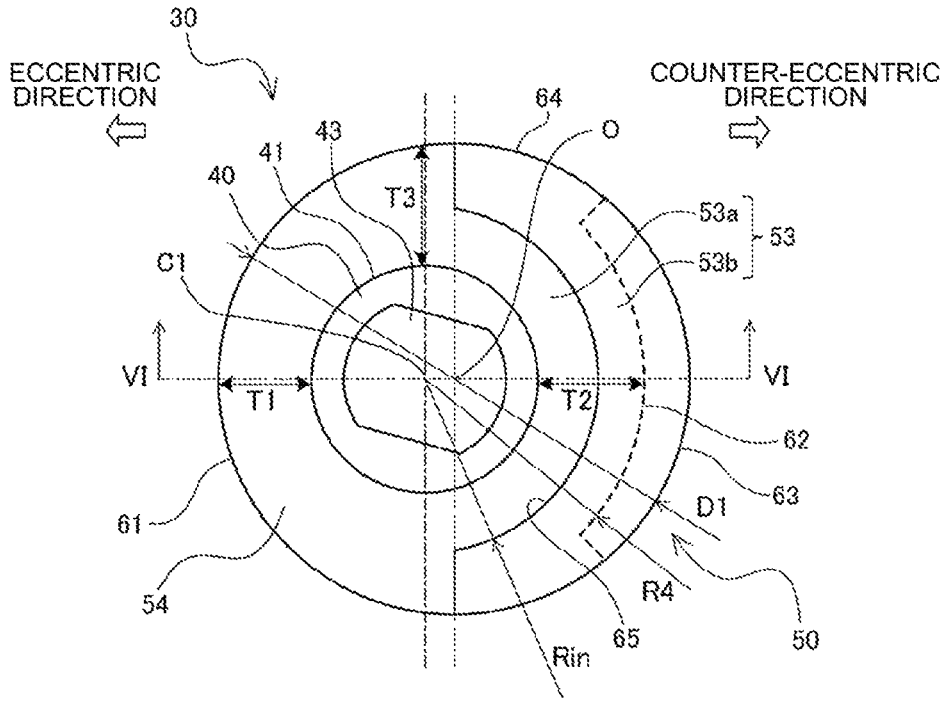
FIG. 5 is a top plan view illustrating the structure of a slider 30 of the scroll compressor 100 according to Embodiment 1 of the present invention.
Figure 6:
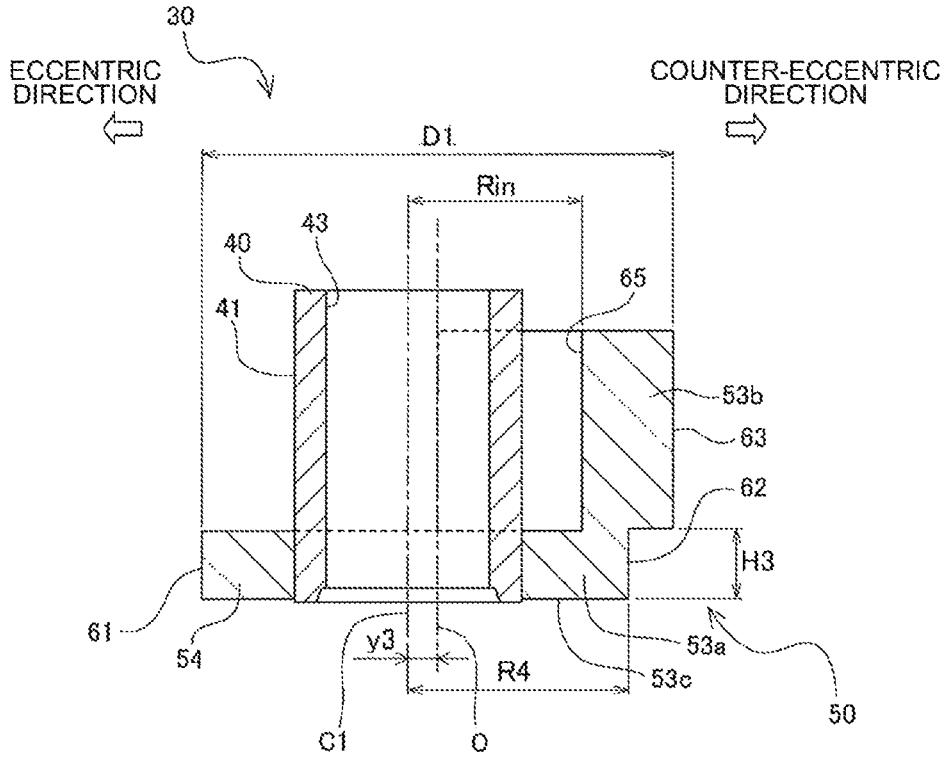
FIG. 6 is a sectional view taken along line VI-VI in FIG. 5.

The slider 30 in Embodiment 1 that can overcome the above-described disadvantages will now be described. FIG. 5 is a top plan view illustrating the structure of the slider 30 of the scroll compressor 100 according to Embodiment 1. FIG. 6 is a sectional view taken along line VI-VI in FIG. 5. In the following description, a direction toward the orbiting scroll 4 relative to the slider 30 may be referred to as "upward" and a direction away from the orbiting scroll 4 may be referred to as "downward". As illustrated in FIGS. 5 and 6, the slider 30 includes the cylindrical portion 40 rotatably supported by the orbiting bearing 14 and the balance weight portion 50 located radially outward of the cylindrical portion 40. The cylindrical portion 40 and the balance weight portion 50, which are different parts molded as separate pieces, are secured to each other by, for example, shrink-fitting or press-fitting.

The cylindrical portion 40 has the same structure as that of the cylindrical portion 40 illustrated in FIGS. 2 to 4. The balance weight portion 50 includes the counter weight part 54 and the main weight part 53 including the first main weight component 53*a* and the second main weight component 53*b*. The balance weight portion 50 is formed by casting or forging. The balance weight portion 50 has an inner circumferential surface secured to an outer circumferential surface 41 of the cylindrical portion 40. The inner circumferential surface of the balance weight portion 50 is a cylindrical surface about the axis C1 of the cylindrical portion 40.

The counter weight part 54 is located in the eccentric direction of the rotation axis O of the slider 30 and is secured to lower part of the outer circumferential surface 41 of the cylindrical portion 40. The counter weight part 54 has an outer circumferential surface 61 (an example of a first outer circumferential surface) that is a partial cylindrical surface having a diameter D1, or a radius D1/2, about the rotation axis O of the slider 30.

The first main weight component 53*a* is located in the counter-eccentric direction of the rotation axis O of the slider 30 and is secured to the lower part of the outer circumferential surface 41 of the cylindrical portion 40. The first main weight component 53*a* has an outer circumferential surface 64 that is a partial cylindrical surface having the diameter D1, or the radius D1/2, about the rotation axis O of the slider 30. In Embodiment 1, the outer circumferential surface 64 of the first main weight component 53*a* has the same axis and the same radius as those of the outer circumferential surface 61 of the counter weight part 54. Thus, the outer circumferential surface 64 of the first main weight component 53*a* and the outer circumferential surface 61 of the counter weight part 54 form a continuous cylindrical surface. The outer circumferential surface 64 of the first main weight component 53*a* may have a radius different from that of the outer circumferential surface 61 of the counter weight part 54.

The first main weight component 53*a* further has, as at least part extending in its circumferential direction, an outer circumferential surface 62 (an example of a second outer circumferential surface) that is a partial cylindrical surface having a radius R4 about the axis C1 of the cylindrical portion 40. The outer circumferential surface 62 is symmetric with respect to a straight line passing through the rotation axis O of the slider 30 and extending parallel to the eccentric direction as viewed in a direction along the rotation axis O. When viewed in the direction along the rotation axis O, the outer circumferential surface 62 in Embodiment 1 is substantially arcuate and extends across an angle of approximately 90 degrees such that the straight line passing through the rotation axis O and extending parallel to the eccentric direction passes through the middle of the outer circumferential surface 62. The outer circumferential surface 62 has a height H3 measured from a lower surface 53*c* of the main weight part 53. The outer circumferential surface 62 is located radially inward of the outer circumferential surface 64 and an outer circumferential surface 63, which will be described later. Thus, the outer circumferential surface 62 serves as a recess located radially inward of the outer circumferential surface 64 and the outer circumferential surface 63.

The second main weight component 53*b* is located in the counter-eccentric direction of the rotation axis O of the slider 30 and protrudes from peripheral part of the first main weight component 53*a* toward the orbiting scroll 4. The second main weight component 53*b* has the outer circumferential surface 63 (an example of a third outer circumferential surface) that is a partial cylindrical surface having the diameter D1, or the radius D1/2, about the rotation axis O of the slider 30. In Embodiment 1, the outer circumferential surface 63 of the second main weight component 53*b* has the same axis and the same radius as those of the outer circumferential surface 64 of the first main weight component 53*a* and those of the outer circumferential surface 61 of the counter weight part 54. Thus, the outer circumferential surface 63 of the second main weight component 53*b* forms a continuous cylindrical surface with both the outer circumferential surface 64 of the first main weight component 53*a* and the outer circumferential surface 61 of the counter weight part 54. The outer circumferential surface 63 of the second main weight component 53*b* may have a radius different from that of the outer circumferential surface 64 of the first main weight component 53*a* and may have a radius different from that of the outer circumferential surface 61 of the counter weight part 54.

The second main weight component 53*b* further has an inner circumferential surface 65 that is a partial cylindrical surface having the radius Rin about the axis C1 of the cylindrical portion 40. The inner circumferential surface 65 of the second main weight component 53*b* faces toward the outer circumferential surface 41 of the cylindrical portion 40, with the boss 4*c* and the orbiting bearing 14 interposed therebetween.

As described above, the scroll compressor 100 according to Embodiment 1 includes the fixed scroll 3, the orbiting scroll 4 orbiting relative to the fixed scroll 3, the main shaft 7 transmitting a rotational driving force to the orbiting scroll 4, the eccentric shaft 7*a* that is located at a first end of the main shaft 7 and is located eccentrically with respect to the axis of the main shaft 7 in the eccentric direction, the slider 30 having the slide hole 43 slidably receiving the eccentric shaft 7*a*, and the orbiting bearing 14 that is located at the orbiting scroll 4 and rotatably supports the slider 30. The slider 30 includes the cylindrical portion 40 rotatably supported by the orbiting bearing 14 and the balance weight portion 50 located radially outward of the cylindrical portion 40. Assuming that the counter-eccentric direction is the direction opposite to the eccentric direction, the balance weight portion 50 includes the counter weight part 54 that is located in the eccentric direction of the rotation axis O of the slider 30 and is joined to the cylindrical portion 40, the first main weight component 53*a* that is located in the counter-eccentric direction of the rotation axis O of the slider 30 and is joined to the cylindrical portion 40, and the second main weight component 53*b* that is located in the counter-eccentric direction of the rotation axis O of the slider 30 and protrudes from the peripheral part of the first main weight component 53*a* toward the orbiting scroll 4. The counter weight part 54 has the outer circumferential surface 61 that is a partial cylindrical surface about the rotation axis O of the slider 30. The first main weight component 53*a* has the outer circumferential surface 62 that is a partial cylindrical surface about the axis C1 of the cylindrical portion 40. The second main weight component 53*b* has the outer circumferential surface 63 that is located radially outward of the outer circumferential surface 62 and that is a partial cylindrical surface about the rotation axis O of the slider 30 and the inner circumferential surface 65 that is a partial cylindrical surface about the axis C1 of the cylindrical portion 40.

In machining the outer circumferential surface 61 of the counter weight part 54 and the outer circumferential surface 63 of the second main weight component 53*b*, the rotation axis O of the slider 30 serves as a machining axis. In machining the outer circumferential surface 62 of the first main weight component 53*a* and the inner circumferential surface 65 of the second main weight component 53*b*, the axis C1 of the cylindrical portion 40 serves as a machining axis. In Embodiment 1, therefore, the number of machining axes required for machining the cylindrical surfaces of the balance weight portion 50 is two. According to Embodiment 1, this results in a reduction in the number of machining steps for the slider 30, thus reducing the machining cost of the slider 30 and the manufacturing cost of the scroll compressor 100.

The first main weight component 53*a* has the outer circumferential surface 62 located radially inward of the outer circumferential surface 63 of the second main weight component 53*b*. This arrangement allows the position of the center of action of a centrifugal force acting on the slider 30 in its axial direction to be shifted toward the orbiting scroll 4. This allows the position of the center of action of the centrifugal force acting on the slider 30 in the axial direction to coincide with the middle of the range of rotation and sliding of the slider 30 and the orbiting bearing 14 in the axial direction. According to Embodiment 1, therefore, uneven contact between the orbiting bearing 14 and the slider 30 can be prevented.

In the scroll compressor 100 according to Embodiment 1, the outer circumferential surface 63 has the same radius D1/2 as that of the outer circumferential surface 61. This arrangement enables machining the outer circumferential surfaces 63 and 61 in the same step. This results in a further reduction in the number of machining steps for the slider 30.

In the scroll compressor 100 according to Embodiment 1, the balance weight portion 50 has a circular shape that is eccentric with respect to the cylindrical portion 40 (for example, the shape of a circle about the rotation axis O of the slider 30) as viewed in the direction along the axis C1 of the cylindrical portion 40. This results in a compact structure of the slider 30 and greater convenience in storing the slider 30 in the recess 2*a* of the frame 2.

In the scroll compressor 100 according to Embodiment 1, R410A refrigerant, R32 refrigerant, or HFO-1234yf refrigerant may be used as a fluid that is compressed between the fixed scroll 3 and the orbiting scroll 4.

Embodiment 2

Figure 7:
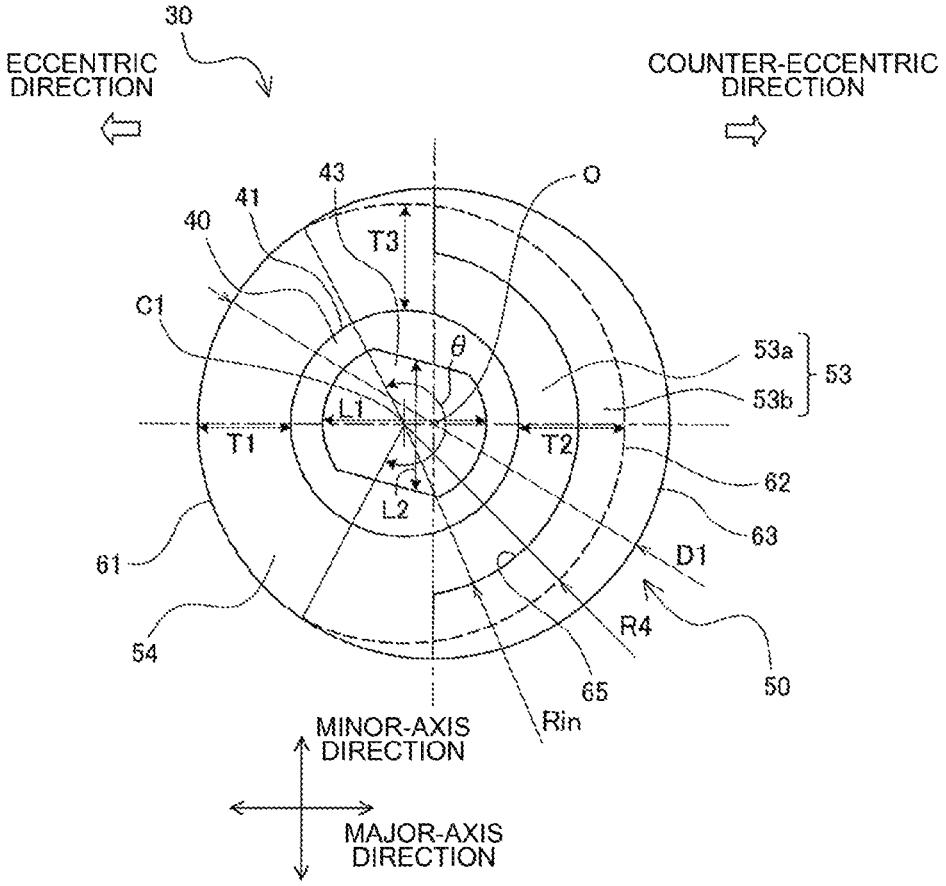
FIG. 7 is a top plan view illustrating the structure of a slider 30 of a scroll compressor 100 according to Embodiment 2 of the present invention.

A scroll compressor according to Embodiment 2 of the present invention will be described. FIG. 7 is a top plan view illustrating the structure of a slider 30 of a scroll compressor 100 according to Embodiment 2. The term "major-axis direction" as used herein refers to a direction that is one of a direction parallel to the eccentric direction and a direction perpendicular to the eccentric direction in a plane perpendicular to the axis C1 of a cylindrical portion 40 and in which a slide hole 43 has a relatively large dimension, and the term "minor-axis direction" as used herein refers to a direction that is the other one of the directions and in which the slide hole 43 has a relatively small dimension. In Embodiment 2, a dimension L1 of the slide hole 43 in the direction parallel to the eccentric direction is larger than a dimension L2 of the slide hole 43 in the direction perpendicular to the eccentric direction. In FIG. 7, the right-left direction parallel to the eccentric direction is the major-axis direction and the up-down direction perpendicular to the eccentric direction is the minor-axis direction. Furthermore, the term "radial thickness" as used herein refers to the thickness of a balance weight portion 50 along its radius about the axis C1 of the cylindrical portion 40 in a plane that is perpendicular to the axis C1 of the cylindrical portion 40 and that includes a junction where the cylindrical portion 40 and the balance weight portion 50 are joined.

In the slider 30 in Embodiment 1 illustrated in FIG. 5, a radial thickness T3 of the balance weight portion 50 in the minor-axis direction is larger than radial thicknesses T1 and T2 of the balance weight portion 50 in the major-axis direction. This leads to an increase in pressure load applied from the balance weight portion 50 to the cylindrical portion 40 in the minor-axis direction in shrink-fitting or press-fitting the cylindrical portion 40 into the balance weight portion 50. The shape of the slide hole 43 of the cylindrical portion 40 is similar to an ellipse having a major axis in the major-axis direction and a minor axis in the minor-axis direction. Thus, under a uniform pressure load applied to the outer circumferential surface of the cylindrical portion 40, the cylindrical portion 40 is likely to deform in such a manner that the outside diameter in the minor-axis direction is smaller than that in the major-axis direction. The cylindrical portion 40 is highly likely to deform in the above-described manner as the pressure load applied to the cylindrical portion 40 in the minor-axis direction increases. The slider 30 in Embodiment 1 may decrease in roundness of the cylindrical portion 40.

As illustrated in FIG. 7, an outer circumferential surface 62, which is located radially inward of outer circumferential surfaces 61 and 63, of the slider 30 in Embodiment 2 extends across an angle θ of 180 degrees or more. In other words, the outer circumferential surface 62 extends over the whole of a first main weight component 53*a* in the circumferential direction and overlaps a counter weight part 54. This results in a relative reduction in radial thickness T3 of the balance weight portion 50 in the minor-axis direction, causing the radial thickness T3 in the minor-axis direction to approach the radial thicknesses T1 and T2 in the major-axis direction. This enables a pressure load applied from the balance weight portion 50 to the cylindrical portion 40 to be substantially uniformed in the circumferential direction, thus preventing a reduction in roundness of the cylindrical portion 40. This allows uniform formation of an oil film between the cylindrical portion 40 and an orbiting bearing 14, leading to improved reliability of the scroll compressor 100.

As described above, in the scroll compressor 100 according to Embodiment 2, the outer circumferential surface 62 extends across the angle θ of 180 degrees or more as viewed in the direction along the axis C1 of the cylindrical portion 40. Such a structure achieves a relative reduction in radial thickness T3 of the balance weight portion 50 in the minor-axis direction. This enables a pressure load applied from the balance weight portion 50 to the cylindrical portion 40 in shrink-fitting or press-fitting the cylindrical portion 40 into the balance weight portion 50 to be substantially uniformed in the circumferential direction, thus preventing a reduction in roundness of the cylindrical portion 40.

Embodiment 3

Figure 8:
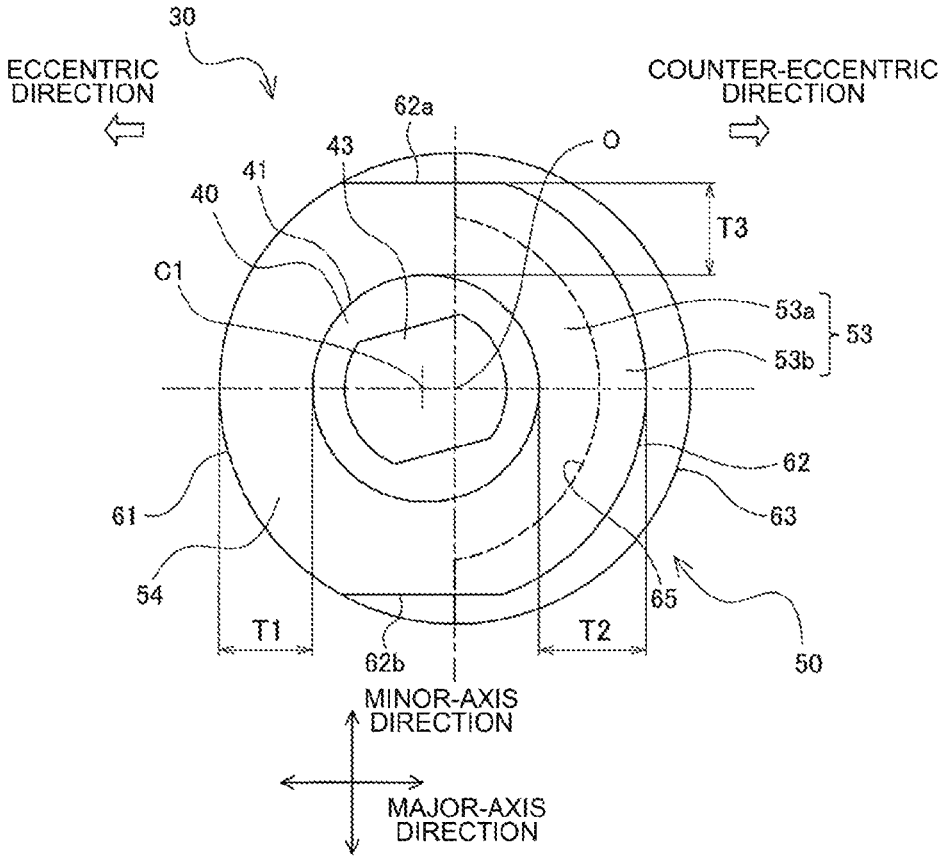
FIG. 8 is a bottom plan view illustrating the structure of a slider 30 of a scroll compressor 100 according to Embodiment 3 of the present invention.

A scroll compressor according to Embodiment 3 of the present invention will be described. FIG. 8 is a bottom plan view illustrating the structure of a slider 30 of a scroll compressor 100 according to Embodiment 3. As illustrated in FIG. 8, an outer circumferential surface 62 includes flat parts 62*a* and 62*b*, which are perpendicular to the minor-axis direction. The flat parts 62*a* and 62*b* are formed by casting or forging. The arrangement of the flat parts 62*a* and 62*b* results in a smaller radial thickness T3 of a balance weight portion 50 in the minor-axis direction than that in the structure of FIG. 7. The radial thicknesses T1, T2, and T3 satisfy the relations: T3 T1; and T3 T2. Such a structure achieves a reduction in pressure load applied from the balance weight portion 50 to a cylindrical portion 40 in the minor-axis direction, thus more reliably preventing a reduction in roundness of the cylindrical portion 40.

Figure 9:
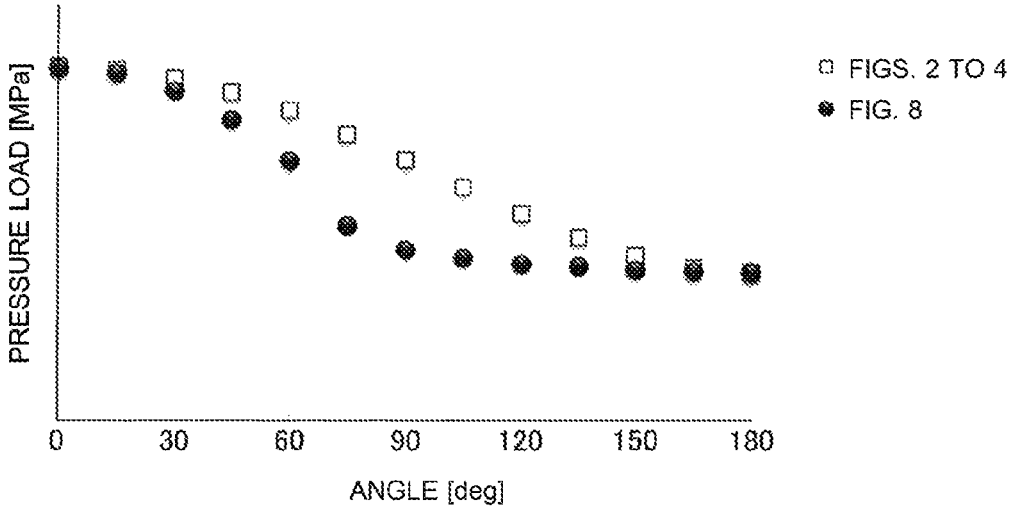
FIG. 9 is a graph showing a distribution of pressure load applied from a balance weight portion 50 to a cylindrical portion 40 of the slider 30 in its circumferential direction in the scroll compressor 100 according to Embodiment 3 of the present invention.

FIG. 9 is a graph showing a distribution of pressure load applied from the balance weight portion 50 to the cylindrical portion 40 in the circumferential direction in the slider 30 of the scroll compressor 100 according to Embodiment 3. The horizontal axis of FIG. 9 represents an angle [deg] viewed from the axis C1 of the cylindrical portion 40. It is assumed herein that an angle in the counter-eccentric direction in FIG. 8 is 0 degrees, an angle in a downward minor-axis direction is 90 degrees, and an angle in the eccentric direction is 180 degrees. The vertical axis of FIG. 9 represents a pressure load [MPa]. In the graph, rectangles represent pressure loads applied to the slider 30 illustrated in FIGS. 2 to 4, and circles represent pressure loads applied to the slider 30 in Embodiment 3 illustrated in FIG. 8. As shown in FIG. 9, the pressure load applied to the cylindrical portion 40 of the slider 30 in Embodiment 3 in the minor-axis direction is smaller than that of the slider 30 illustrated in FIGS. 2 to 4 in the minor-axis direction. Thus, a reduction in roundness of the cylindrical portion 40 can be prevented. This allows uniform formation of an oil film between the cylindrical portion 40 and an orbiting bearing 14, leading to improved reliability of the scroll compressor 100.

Although the flat parts 62*a* and 62*b* are perpendicular to the minor-axis direction in the structure of FIG. 8, the flat parts 62*a* and 62*b* may extend along the major axis of a slide hole 43. This arrangement enables a pressure load applied from the balance weight portion 50 to the cylindrical portion 40 to be further uniformed in the circumferential direction.

As described above, it is assumed herein that the major-axis direction is the direction that is one of the direction parallel to the eccentric direction and the direction perpendicular to the eccentric direction in the plane perpendicular to the axis C1 of the cylindrical portion 40 and in which the slide hole 43 has a relatively large dimension, the minor-axis direction is the direction that is the other one of the directions and in which the slide hole 43 has a relatively small dimension, and the radial thickness is the thickness of the balance weight portion 50 along its radius about the axis C1 of the cylindrical portion 40 in the plane that is perpendicular to the axis C1 of the cylindrical portion 40 and that includes the junction where the cylindrical portion 40 and the balance weight portion 50 are joined. Based on the above-described assumption, the radial thickness T3 of the balance weight portion 50 in the minor-axis direction in the scroll compressor 100 according to Embodiment 3 is smaller than or equal to the radial thickness T1 of the balance weight portion 50 in the major-axis direction and is smaller than or equal to the radial thickness T2 of the balance weight portion 50 in the major-axis direction. This structure achieves a reduction in pressure load applied to the cylindrical portion 40 in the minor-axis direction in shrink-fitting or press-fitting the cylindrical portion 40, thus preventing a reduction in roundness of the cylindrical portion 40.

REFERENCE SIGNS LIST

1 hermetic container 1*a* barrel 1*b* top 1*c* bottom 2 frame 2*a* recess 3 fixed scroll 3*a* end plate 3*b* lap 4 orbiting scroll 4*a* end plate 4*b* lap 4*c* boss 5 stator 6 rotor 7 main shaft 7*a* eccentric shaft 8 oil sump 9 oil pump 10 suction pipe 11 discharge pipe 12 Oldham ring oil hole 14 orbiting bearing 15 scavenge oil pipe 16 main bearing 17 subbearing 18 subframe 19*a* first balancer 19*b* second balancer 20 compression mechanism 21 motor mechanism 22 discharge port 23 discharge chamber 24 discharge valve 30 slider 40 cylindrical portion 41 outer circumferential surface 43 slide hole 50 balance weight portion 51 flat part 52 protrusion 53 main weight part 53*a* first main weight component 53*b* second main weight component 53*c* lower surface 54 counter weight part 61, 62, 63, 64 outer circumferential surface 62*a*, 62*b* flat part 65 inner circumferential surface 100 scroll compressor C1 axis O rotation axis

The invention claimed is:

1. A scroll compressor comprising:

a fixed scroll;

an orbiting scroll orbiting relative to the fixed scroll;

a main shaft transmitting a rotational driving force to the orbiting scroll;

an eccentric shaft disposed at a first end of the main shaft, the eccentric shaft being located eccentrically with respect to an axis of the main shaft in an eccentric direction;

a slider having a slide hole slidably receiving the eccentric shaft; and an orbiting bearing located at the orbiting scroll, the orbiting bearing rotatably supporting the slider, wherein the slider includes a cylindrical portion rotatably supported by the orbiting bearing and a balance weight portion located radially outward of the cylindrical portion, wherein assuming that a counter-eccentric direction is a direction opposite to the eccentric direction, the balance weight portion includes a counter weight part located in the eccentric direction of a rotation axis of the slider and joined to the cylindrical portion, a first main weight component located in the counter-eccentric direction of the rotation axis of the slider and joined to the cylindrical portion, and a second main weight component located in the counter-eccentric direction of the rotation axis of the slider and protruding from peripheral part of the first main weight component toward the orbiting scroll, wherein the counter weight part has a first outer circumferential surface that is a partial cylindrical surface centered about the rotation axis of the slider, wherein the first main weight component has a second outer circumferential surface that is a partial cylindrical surface centered about an axis of the cylindrical portion, and wherein the second main weight component has a third outer circumferential surface that is located radially outward of the second outer circumferential surface and that is a partial cylindrical surface centered about the rotation axis of the slider and an inner circumferential surface that is a partial cylindrical surface centered about the axis of the cylindrical portion.

2. The scroll compressor of claim 1, wherein the third outer circumferential surface has a radius identical to that of the first outer circumferential surface.

3. The scroll compressor of claim 2, wherein the balance weight portion has a circular shape that is eccentric with respect to the cylindrical portion as viewed in a direction along the axis of the cylindrical portion.

4. The scroll compressor of claim 1, wherein the second outer circumferential surface extends across an angle of 180 degrees or more as viewed in a direction along the axis of the cylindrical portion.

5. The scroll compressor of claim 1, wherein assuming that a major-axis direction is a direction that is one of a direction parallel to the eccentric direction and a direction perpendicular to the eccentric direction in a plane perpendicular to the axis of the cylindrical portion and in which the slide hole has a relatively large dimension, a minor-axis direction is a direction that is an other one of the directions and in which the slide hole has a relatively small dimension, and a radial thickness is a thickness of the balance weight portion along a radius of the balance weight portion about the axis of the cylindrical portion in a plane that is perpendicular to the axis of the cylindrical portion and that includes a junction where the cylindrical portion and the balance weight portion are joined, the radial thickness of the balance weight portion in the minor-axis direction is smaller than or equal to that of the balance weight portion in the major-axis direction.

6. The scroll compressor of claim 1, wherein R410A refrigerant, R32 refrigerant, or HFO-1234yf refrigerant is used as a fluid that is compressed between the fixed scroll and the orbiting scroll.

7. The scroll compressor of claim 1, wherein the balance weight portion comprises an integrally formed balance weight portion including the counter weight part, the first main weight component, and the second main weight component.

* * * * *